United States Patent [19]

Nakajima et al.

[11] Patent Number: 4,939,006

[45] Date of Patent: Jul. 3, 1990

[54] THREE DIMENSIONAL FABRIC HAVING A UNIQUE STRUCTURE AND ITS METHOD OF PREPARATION

[75] Inventors: Tamotu Nakajima, Shiga; Shusuke Yoshida, Otsu, both of Japan

[73] Assignee: Toray Industries, Inc., Tokyo, Japan

[21] Appl. No.: 311,563

[22] Filed: Oct. 21, 1988

Related U.S. Application Data

[63] Continuation-in-part of PCT JP 88/00204 filed Feb. 26, 1988.

[51] Int. Cl.[5] ..... B32B 33/00

[52] U.S. Cl. ..... 428/25; 428/16; 428/88; 428/90; 428/92; 428/96; 428/155

[58] Field of Search ..... 428/15, 88, 89, 16, 428/90, 92, 96, 155

[56] References Cited

U.S. PATENT DOCUMENTS

| | | | |
|---|---|---|---|
| 3,334,006 | 8/1967 | Koller | 428/88 |
| 3,973,065 | 8/1976 | Walsh et al. | 428/89 |
| 4,390,572 | 6/1983 | Okamoto | 428/15 |

*Primary Examiner*—Marion C. McCamish
*Attorney, Agent, or Firm*—Armstrong, Nikaido, Marmelstein, Kubovcik & Murray

[57] ABSTRACT

The present invention relates to a new fabric which is rich in a new, raw material feeling which has been unparalleled before, a fashionable feeling and an unexpected feeling and to its method of preparation. The fabric of the present invention is a three dimensional fabric having a unique structure characterized by a structure wherein a mass of a number of apexes of piled fibers is made in a body to form a scaly structure and a number of said scaly structures cover the surface layer of the fabric. Moreover, the method for preparing the three dimensional fibrous fabric of the present invention is characterized by the method wherein the piled layer of a piled fabric having a lot of piles made of fibers is treated by a pressing treatment under heating and compression to adhere the piled surface layer being formed with the apexes of piles over a wide area and to make thereby it in a body with a film-shape, and thereafter a lot of scaly structures are formed by crumpling the said fabric and by splitting the above described film-shaped monolithic structure into units of small area. The three dimensional fabric of the present invention can be widely used in such various applications as outer wears and so on by utilizing its new, raw material feeling, unexpected feeling and fashionable characteristic.

5 Claims, 4 Drawing Sheets

THREE DIMENSIONAL FABRIC HAVING A UNIQUE STRUCTURE AND ITS METHOD OF PREPARATION

This application is a continuation-in-part of PCT JP88/00204, filed Feb. 26, 1988.

DESCRIPTION

1. Technical Field

The present invention relates to a new fabric which is rich in a new, unparalleled raw material feeling, a fashionable feeling and an unexpected feeling.

In more detail, the present invention relates to a three dimensional fibrous fabric having a new structure having many scaly structures covering the surface layer of the fabric and to its method of preparation.

2. Background Art

Fabrics similar to the present invention have never been seen before. The closest would be a fabric prepared by embossing a scaly structure such as an embossing treatment of an artificial leather and followed by an enamel treatment on the surface.

However, in the conventional fabric like this, the surface and cross-sectional structures have poor cubic effects. It looks artificial and a natural feeling is scarce because the surface shape is in a regular manner. The feeling is very rough and hard and it looks paper-like.

DISCLOSURE OF INVENTION

Technological problems to be solved by the present invention are the need for a new fabric which is rich in a new raw material feeling which has been unparalleled and has an unexpected feeling and at the same time a fashionable feeling, and the need for a method for preparing said fabric.

The present invention has the following constitution.

Namely, the fabric of the present invention is a three dimensional fabric having a unique structure characterized by a mass of a number of apexes of piled fibers made in a body to form a scaly structure and a mass of said scaly structure covering the surface layer of the fabric.

Moreover, the method for preparing the three dimensional fabric having the unique structure of the present invention is characterized by the method wherein the piled layer of a piled fabric having a lot of piles made of fibers is treated by a pressing treatment under heating and compression to adhere the piled surface layer being formed with the apexes of piles over a wide area and thereby make the piles in such wide area into a body, and thereafter, crumpling the scaly structures of said fabric and by splitting the above described film-shaped monolithic structure into units of small area.

Compared to the conventional products which are easily distinguished as being artificial products, the present invention offers a three dimensional fabric having a new, unique structure and a method for preparing it wherein the fabric has not been seen before as a fiber product. The surface appearance exhibits a scaly structure which has an outer appearance and luster rich in a feeling of a natural product and a new raw material such as mineral-like, namely mica-like and coal-like, bagworm-like or an outer appearance of the surface skin of a pine tree and at the same time has a feeling being three dimensional and is excellent in flexibility.

In more detail, the three dimensional fabric having a unique structure offered by the present invention has practical effects as described in the following (1) to (9) which have not been seen in similar, conventional fabrics.

(1) A fabric whose outer appearance exhibits an aspect being very rich in a natural feeling such as scale-like, mineral-like, surface skin-like of a pine tree, bagworm-like and so on and having never been seen in the conventional product and being rich in a new raw material feeling and an unexpected feeling, is offered by the scaly structure covering the surface layer of the fabric.

(2) The scaly structure covering the surface layer of the fabric gives a characteristic luster feeling by the phenomenon of reflection of light due to its flat-shape and thereby a fabric having esthetic and fashionable feelings is offered. Such a unique luster feeling is especially remarkable in a deep color such as black and so on.

(3) Contrary to the outer appearance of the surface which is apparently rough and hard, a fabric which is rich in flexibility is offered.

(4) A fibrous fabric whose whole outer appearance is rich in a cubic effect is offered because it is constituted by a three dimensional fabric and forms scaly structures of various areas.

Because each scaly structure is constituted by an independent apex part of piles, independent movement is possible to some extent and it is therefore possible to obtain changing effects of outer appearance and luster in accordance with the movement of the fabric while in use.

(5) Because the intermediate layers between the bottom of the piles and the inside of the scaly structures are constituted by many piles fibers, the ratio of vacancy is high, and good heat retaining, flexibility, cushioning characteristics can be obtained by a structure wherein said intermediate layers exist.

(6) Because almost the whole fabric surface is covered with scaly structure of flat shapes, the fabric repels water and does not allow wind to pass through. Namely, it has both good windbreak performance and water repellency.

(7) The fabric has two different characteristics, namely both being rich in rural beauty and having high class, new raw material feeling.

(8) It is possible to cut the fabric by a cutter, scissors and so on in the same way as ordinary fibrous fabric. No fluff is practically generated, and it is easy to produce various final manufactured goods.

(9) In case wherein the apex parts of piled fibers with a resin are made in a body as a group with a flatshape, said scaly structure has excellent durability and therefore can keep a new raw material feeling, an unexpected feeling and the good, fashionable characteristics which are the expected effects of the present invention.

BEST MODE FOR CARRYING OUT THE INVENTION

A three dimensional fabric having the unique structure of the present invention and its method of preparation will be hereinafter further explained in detail.

The scaly structure in the present invention means a structure wherein apexes of a number of piled fibers are made in a body as a group with a flat-shape and exist on the surface layer of the fabric like scales and the fabric of the present invention is constituted by many of these scaly structures covering the surface of the fabric layer.

As the three dimensional fabric having a unique structure of the present invention, the base fabric is constituted by a piled fabric, for example, a double velludo fabric, a chinchilla fabric, woven and knitted fabrics using chenille yarns, a piled tricot, other warp knitted piled products, an electric flock, a mechanical flock and so on, but it is not restricted thereto and any fabric having a lot of piles, for example, piled fabric prepared by other method of preparation, can be used.

Figure 1:
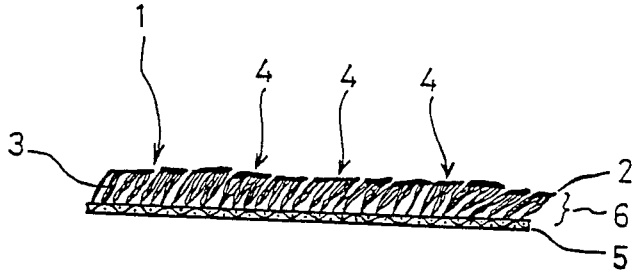
FIG. 1 is a cross-sectional drawing showing an example of a cross-sectional structure of the three dimensional fabric having the unique structure of the present invention as a model.

FIG. 1 is a rough model cross-sectional picture showing an example of a cross-sectional structure of the three dimensional fabric having the unique structure of the present invention as a model.

As shown in FIG. 1, the three dimensional fabric 1 of the present invention comprises a three layer structure of piled fibers 3 having a face surface 2, an opposite fabric surface 5 and piled body 6 with a flat-shape by self-adhering action due to heat-fusion of the polymer of piled fibers 3, between the face surface 2 and the opposite surface 5, adhered at the opposite surface end of such piled fibers 3, such as by weaving, knitting, an adhesive, or the like, to the opposite fabric surface 5. The ground or opposite fabric surface 5 is the most lower layer among three layers and the piled fiber body 6 is the intermediate layer among three layers. In the intermediate layer, the piled fibers 3 usually exist in an inclined state and stand close together.

Figure 2:
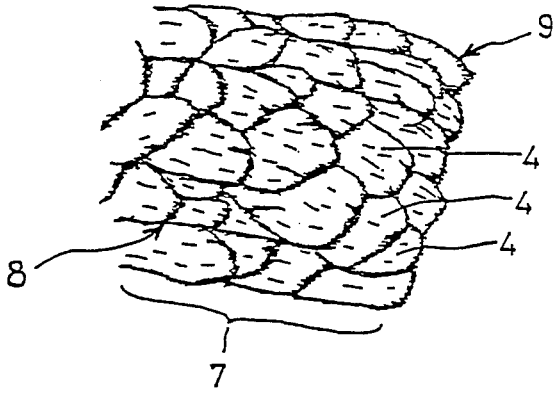
FIG. 2 is a drawing of a top plan view of the surface showing the scaly structure of the fabric of the present invention.

A number of the above described faces 4 shown in the drawing in FIG. 1 are formed on the surface of the fabric in such a way that they cover the whole area of said fabric. The drawing in FIG. 2 shows the surface of the fabric.

A scaly-like structure 7 is formed as a whole by locating a number of faces 4 densely covering the surface with lines or edges 8 therebetween. A unit face (a scale constituting unit) 4 of scaly-like structures adjoining each other are separated by lines or boundaries 8 on the surface outer appearance, but practically connected through piled fibers 3, a ground texture 5 and other piled fibers 3. Namely, a number of piled fibers 3 existing between the scaly-like structure 7 and the ground texture 5, are inclined in general, but stand close together, as piled fibers, to form an intermediate layer having high ratio of vacancy constituted by a number of piled fibers. The opposite fabric surface 5 holds said piled fibers 3 and constitutes a base fabric 5 of the three dimensional fabric 1 of the present invention. The length of the part of piled fibers in the intermediate layer is preferably in the range of 1 to 40 mm to sufficiently exhibit the effect of the above described structure of three layers.

Based on this structure, the three dimensional fabric of the present invention has a mass of the scaly structures on its surface layer wherein each scaly structure 7 constituted by a face 4 can move independently to some extent from the adjoining scaly structure 7. Because the three dimensional fabric of the present invention has a unique state and structure like this, the outer appearance exhibits an aspect being very rich in a natural feeling which is not seen in the conventional products such as scale-like, mineral-like, surface skin-like of pine tree, bagworm-like and so on and when said three dimensional fabric is bent and curved, adjoining scaly structures are separated three-dimensionally and the insides of these scales can be exposed. These unique appearance and movement characteristics of the scaly structure offer a fabric which is rich in a new, raw material feeling, an unexpected feeling and a highly fashionable characteristic.

Figure 3:
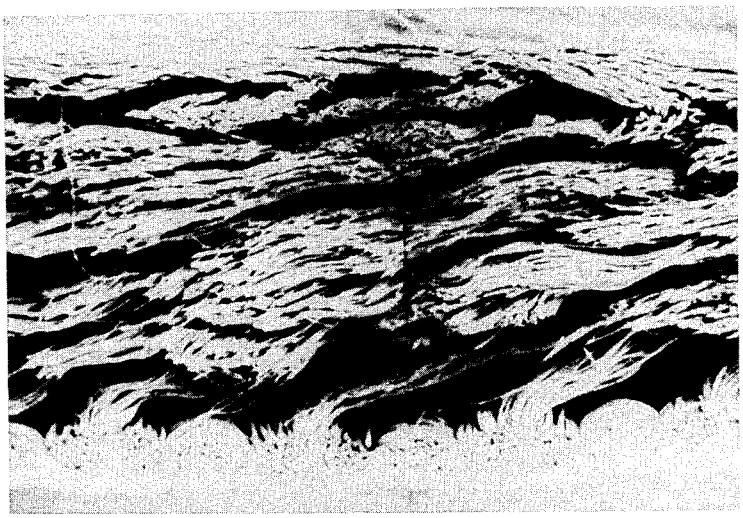
FIG. 3 is a microscopic picture showing an example of a cross-sectional shape of the fabric of the present invention.

FIG. 3 is a cross-sectional microscopic picture showing an example of a cross-sectional shape of the fabric having the unique structure of the present invention and a microscopic picture showing an enlargement of an actual cross-sectional fabric structure corresponding to the model figure shown in FIG. 1.

Figure 4:
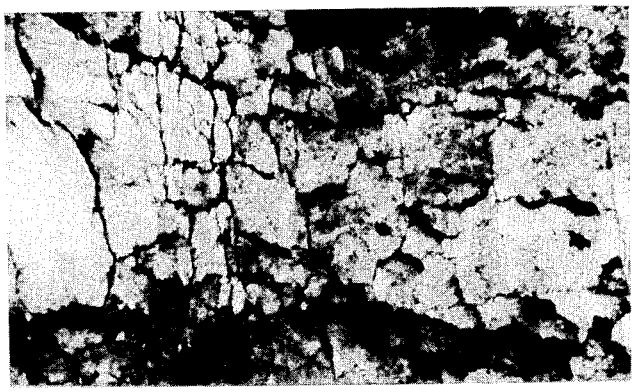
FIG. 4 is a microscopic picture enlarging the fabric surface, which shows an example of the outer appearance of the scaly structure of the fabric of the present invention wherein the area of a constituent unit is relatively large and the size is not relatively uniform.

FIG. 4 is a microscopic picture of the fabric structure, which shows an example of the outer appearance of the scaly structure wherein the area of a constituent unit of the scaly structure of the three dimensional fabric having the unique structure of the present invention is relatively large and the size is not relatively uniform.

Figure 5:
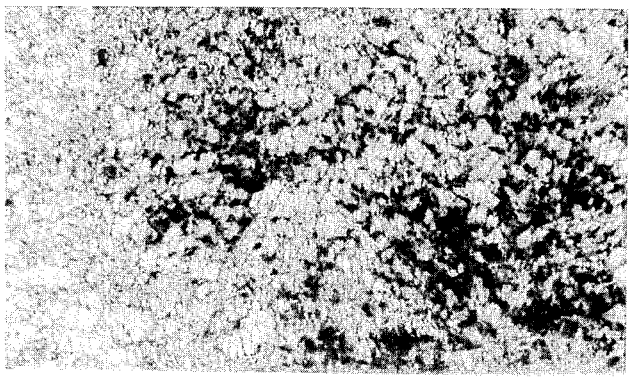
FIG. 5 is a microscopic picture of the fabric surface showing an example of the outer appearance of the scaly structure wherein the area of a constituent unit is relatively small in the fabric of the present invention.

FIG. 5 is a microscopic picture of the fabric surface showing an example of the outer appearance of the scaly structure wherein the area of a constituent unit is relatively small in the fabric having the unique structure of the present invention.

Figure 6:
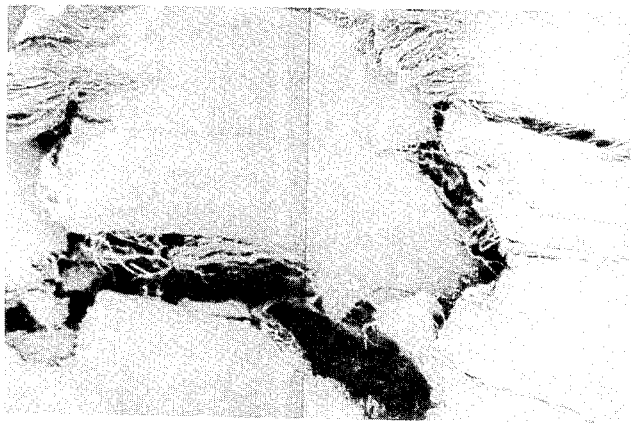
FIG. 6 is a microscopic picture enlarging further a part of the scaly structure of the three dimensional fabric of the present invention.

FIG. 6 is a microscopic picture enlarging further a part of the scaly structure of the fabric having the unique structure of the present invention.

Figure 7:
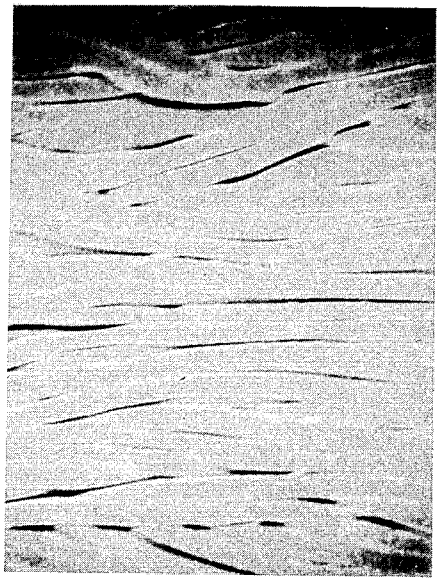
FIG. 7 is a microscopic picture of the fabric surface enlarging further more a part of the scaly structure shown in FIG. 6.

FIG. 7 is a microscopic picture of the fabric surface enlarging further a part of the scaly structure.

Moreover, in three dimensional fabric of the present invention, it is preferable that at least in a part of the circumferential part of the apex of the scaly structure, a fibrous state partly appears in the split state. The split state exhibiting said fibrous state means, as shown with 9 in FIG. 2, a state wherein the circumferential part of the apex of the scaly structure is substantially separated in fibrous state. By controlling the forming state of the scaly structure and the adhering state in a body of the apex of the piles, a new, raw material feeling and a feeling of natural product of the outer portion of the fabric, which the three dimensional fabric of the present invention has, can be strengthened. Moreover, the touch thereby hardly becomes paper-like and it has flexibility and a cubic effect and becomes fashionable.

The three dimensional fabric having the above described unique structure of the present invention can be prepared by (1) using a piled fabric having a number of piled fibers such as the above described double velludo fabrics such as a single pile, a multi pile and so on, chinchilla fabric, woven and knitted fabrics using chenille yarns, piled tricot, other warp knitted piled products, electric flock, mechanical flock and so on as a raw material fabric, (2) carrying out a pressing treatment under heating and compression on the piled layer of the said piled fabric to adhere the piled surface layer which the apexes of the piles form in a body and in a film-shape over a wide area, and (3) crumpling thereafter said fabric to split the above described film-like monolithic structure into a number of units of small area and to form thereby a number of scaly structures.

Pile length of the piled fabric largely influences formability of the scaly structure. Namely, if the pile length is large, it is easy to make the apexes of piles in a body with a flat-shape and therefore easy to form a scaly structure. On the other hand, if the length is small, it is difficult to make the apexes of pile in a body and formability of a scaly structure is poor. In view of this fact, 3 mm or more is preferable for the pile length, and 5 mm or more is more preferable. The upper limit of the length of the pile is not specially restricted, but the length up to about 45 mm is practical from the view point of the manufacturing technology of piled fabrics.

Single filament denier of the fiber forming the piled part is not specifically restricted. However, taking formability, durability and esthetic appearance of a scaly structure into consideration, it is preferable that a ultra-fine artificial fiber whose denier is 1 denier or less, more preferably 0.5 denier or less, is used.

Moreover, as the density of numbers of piles of the piled fabric for the raw material, an amount of more than 5,000 piles/$cm^2$ is preferable. Especially, the production of a super ultra-fine fiber whose denier is 0.01 denier or less is surely possible by means of present manufacturing technology of an ultra-fine piled fabric, so that a piled fabric of an ultra-high pile density whose value is 5 to 6 million piles/$cm^2$ can be prepared with this super ultra-fine fiber. This piled fabric having such an ultra-high pile density can therefore be used to obtain a three dimensional fabric of the present invention. However, to the knowledge of the present inventors, it is preferable that in general, a high pile density of about 10,000 to 200,000 piles/$cm^2$ is used, taking the practical ease of production into consideration. In general, it is desirable that the number of piles per unit area is larger because larger numbers of masses and the condition of flat-shape can be more easily prepared in such a case. For these reasons, it is desirable that the above described ultra-fine artificial fiber whose denier is 1 denier or less is used because it can result in an increase in the number of piles.

The average value of the area of a constituent unit of the scaly structure is an important factor for obtaining the expected effects of the present invention, especially the effect of the outer appearance having the fashionable characteristics. To the knowledge of the present inventors, it is preferable that the value is in the range of $0.5\times10^{-2}$ $cm^2$ (0.5 mm square) to $1\times10^2$ $cm^2$ (10 cm square) and it is more preferable that it is in the range of $2\times10^{-2}$ $cm^2$ to $1\times10$ $cm^2$.

For example, in case of the scaly structure having a small pattern and a mild feeling, the range of about $0.5\times10^{-2}$ $cm^2$ to $6\times10^{-2}$ $cm^2$ is preferable. On the other hand, in case of the scaly structure having an intermediate pattern and a relatively bold feeling, the range of about $6\times10^{-2}$ $cm^2$ to $1\times10$ $cm^2$ is preferable. Moreover, in case of the scaly structure having a large pattern and an even bolder feeling, the range of about $1\times10$ $cm^2$ to $1\times10^2$ $cm^2$ is preferable.

In the present invention, the average value of the area of a constituent unit of the scaly structure V can be obtained by calculating the number of the scaly structures per unit area 100 $cm^2$ from the following equation (1)

$$V = 100\ cm^2/\text{numbers of the scaly structure} \quad (1)$$

Wherein the sampling area of 100 $cm^2$ is not adequate because of a large pattern and so on, larger sampling area can be properly taken. After all, the average value of the area of a constituent unit should be obtained by dividing the value of the sampling area by the number of the scale structures existing in the area.

If the patterns in these area range of are a mixture of masses having properly random sizes and properly random shapes without any definite pattern, the appearance overflows with natural feeling and it is esthetically excellent.

If the average value of the area of a constituent unit of the scaly structure is $0.5\times10^{-2}$ $cm^2$ or less, the merit of the existence of the scaly structure decreases and the surface appearance is no different from an ordinary simple piled fabric and lacks uniqueness. On the other hand, if the value exceeds $1\times10^2$ $cm^2$, the whole surface state is a flat one like an film sheet and lacks a cubic effect and the touch is papery. It is not desirable in general. However, in the application field such as wall decorative material and so on wherein a material of large size is generally used, such a large pattern of the scaly structure as one exceeding $1\times10^2$ $cm^2$ can be used. After all, the appropriate size changes in accordance with various practical applications.

As a raw material constituting the fabric of the present invention, either a natural fiber or a synthetic fiber can be used and a properly blended one can be also used. However, as a fiber forming the piled parts, a heat fusing fiber is preferable, and a synthetic fiber is especially preferable. As the examples of the raw material for the synthetic fiber, polyethylene terephthalate or its copolymer (for example, a copolymerizable component such as 5-sodium sulfoisophthalic acid), polybutylene terephthalate or its copolymer, polyamides such as nylon 66, nylon 6 and nylon 12, polyacrylonitrile type polymers can be preferably used. Polymer compositions wherein modifiers and additives are blended with these polymers for the purposes of destaticizing, improving dyeability, delustering, stain-proofing, fire retarding and shrink-proofing, can be properly preferably used.

As a practical method for carrying out a press treatment under heating and compression on a pile layer of a piled fabric, adhering a surface layer of the piles formed with apexes of the piles over a wide area and making it into a body with a film-like state, a method wherein the pile layer is pressed by means of heated calendar rolls and heat treatment is carried out while the pile layer is being compressed, is the most practical one. Besides the calendar roll method, a compression treatment using a heated plate can be used. When a roll or a plate is used for pressing, the face of the press may be either flat or uneven. In the present invention, pressing is generally carried out by means of a press surface with a mirror surface, but an embossing roll or an embossing plate having an embossing pattern of a regular shape or an irregular shape can be used for pressing. By doing so, a three dimensional fabric having a three dimensional pattern with an embossed pattern and being rich in more fashionable feeling is obtained.

A scaly structure can be effectively formed by means of the above described process, but to make the shape retaining property and durability of said formed scaly structure stronger, a method for fixing said scaly structure with a resin is preferably used. To fix the scaly structure with said resin, a process order wherein the resin is adhered at least on the surface layer of said fabric whole piles are being made in a body before crumpling and a crumpling treatment is thereafter carried out on it to split it into units of small area and to form a number of scaly structure, can be used. On another process order wherein a number of scaly structures are formed at first by carrying out a crumpling treatment and then the resin is adhered at least on the parts of said scaly structures, can be also used.

On the point of touch, a more flexible and soft product can be obtained by the former process order, but the latter process order is superior to the former from the point of durability and shape retaining property.

As the resins used in this process, acrylic, melamine, vinyl acetate and epoxy resins, their copolymer resins, and high polymer elastomers such as butadiene copolymers, vinyl chloride copolymers and polyurethane are used.

As the method for adding the resin, a process comprising impregnation with the resin→squeezing→drying → curing, and coating methods such as direct transferring, gravure, spraying and so on are preferably used, but it is not specially restricted and is properly selected in accordance with the touch and other characteristics desired.

The heating temperature in the calendar roll treatment on a pile layer of a piled fabric should be properly selected in accordance with a raw material of the piled fiber, but in general a range of 120° to 230° C. is preferable and a range of 160° to 210° C. is more preferable. Namely, it is preferable that the treatment is carried out at the temperature wherein the piled fiber reaches a semimolten state. It is therefore difficult to form a scaly structure at too a low temperature condition. On the other hand, at too a high temperature condition, there is a possibility that the physical properties and dyeing fastness of the fabric will decrease. Therefore the above described temperature range, 120° to 230° C., is the most appropriate temperature.

Five kg/cm$^2$ or more is preferable for the treating pressure of the compression press, and 20 kg/cm$^2$ or more is more preferable. Below 5 kg/cm$^2$, the pressing pressure is too low and scaly structure formation and durability of the formed pattern are insufficient. To treat in a range of 20 to 100 kg/cm$^2$ is an ordinary condition.

When a heat calendar roll machine is used as a means of heat compression press treatment, said calendar roll machine has generally a three roll structure in which the central cylinder roll is heated and the upper and the lower two plastorolls cannot be heated. It is therefore important that the piled part is contacted with the surfaces of heated cylinder rolls and thereby heat treated. As the treating speed, 0.5 to 20 m/min is preferable is accordance with the kind of machine, and 2 to 10 m/min is more preferable. Above 20 m/min, a fusing effect is poor and a desired mass of the apexes of piles is hardly made in a body with a flat-shape and therefore hardly forms a scaly structure. Durability of shape of the scaly structure is also insufficient.

Formation of the scaly structure is largely influenced by the piled condition and the treating direction of a lie of piles of the fabric before heat press treatment. Namely, to obtain a product whose average area of a constituent unit of the scaly structure is $0.5\times10^{-2}$ cm$^2$ to $6\times10^{-2}$ cm$^2$, namely small and whose shapes are relatively uniform, handling and managing of the piles are made in a good condition in advance by means of brushing and treatment with a finishing agent such as silicones and so on. Then a treatment under pressure and heating is performed on the piled fabric to make the pile direction in the following direction, namely, to constitute the pile fiber layer in a laid state, said treatment being carried out at a relatively lower temperature (at around 180° C. if the raw material of the piles is polyethylene terephthalate).

On the other hand, to obtain a product whose average area of a constituent unit of the scaly structure is $6\times10^{-2}$ cm$^2$ or more and which has a surface condition of an intermediate or large pattern, it is desirable on the contrary that a material wherein handling and managing of the piles are in a bad condition (i.e., the pile direction is in a reverse direction and the pile fiber layer is in a laid state) be treated by means of a press and heat treatment at a higher temperature (at around 200° C. if the raw material of the piles is polyethylene terephthalate).

Moreover, to obtain a product wherein various small, intermediate and large patterns exist in a mixed state and whose average area of a constituent unit is in a range of $10^{-2}$ cm$^2$ to $10^2$ cm$^2$, it is preferable to crumple the intermediate or large pattern product by hand or mechanically.

To carry out a mechanical crumpling treatment, one can utilize various apparatus, even those not manufactured for the purpose to carry out crumpling treatments. Various apparatus for softening fabrics, for example, a so called vibraker, liquid bath treating apparatus in a such as a wince dyeing machine, a liquid flow dyeing machine and so on, a tumble apparatus which physically lifts up and drops a fabric, a beating apparatus which hits a fabric with a bar, a guiding apparatus constituting plural bars for running a fabric in a curved way and so on, can be properly utilized.

Moreover, to obtain the three dimensional fabric of the present invention having a substantial number of scaly structures of a fixed pattern, it is possible to use a splitting technique such as rubbing and splitting to make an optional single shape or mixed shapes such as triangles, rectangles, polygons, circles, ellipses and so on and/or optional sizes of these shapes, by using a knife with an edge and so on.

In the preceding or the following process of making a scaly structure of the three dimensional fabric of the present invention, coating treatment of the back surface, desizing-scouring and heat setting treatment, treatment for making ultra-fine fibers in case of using an artificial fiber being capable of making ultra-fine fibers, dyeing, sizing, and drying and so on in the same way as ordinary piled woven and knitted fabrics, are suitably carried out.

Moreover, in the case of the conventional ordinary piled fabrics, a backing treatment is generally done on the back surface of the fabric with a resin coating and so on in many cases to prevent falling out of piles, but on the fabric of the present invention, the problem of piles falling out hardly occurs because the surface layer of the fabric is constituted by a scaly structure. The backing treatment is therefore not necessarily needed.

Moreover, water repelling treatment, flame retarding treatment, stain resistant treatment and so on may be suitably done, if necessary, on the three dimensional fabric of the present invention.

The present invention will be more concretely explained by the following examples.

EXAMPLE 1

The following two types of islands-in-a-sea type composite fibers were spun and drawn to obtain blended composite fibers of 73 denier—18 filaments.

| | | |
|---|---|---|
| (a) | The islands-in-a-sea type composite fiber No. 1 | |
| | Island component: | Polyethylene terephthalate (16 islands) |
| | Sea component: | Polystyrene |
| (b) | The islands-in-a-sea type composite fiber No. 2 | |
| | Island component: | Polyethylene terephthalate copolymerized with 10 mole % of isophthalic acid (16 islands) |
| | Sea component: | Polystyrene |

Here, the island-in-a-sea type composite fiber No. 1 comprised 80% of the island component and 20% of the sea component, and the whole fiber was 36.5 denier 9 filaments. The island-in-a-sea type composite fiber No. 2 comprised 80% of the island component and 20% of the sea component, and the whole fiber was 36.5 denier 9 filaments. Therefore, a blended fiber of total 73 denier—18 filaments was obtained.

This blended composite fiber was used as a pilable fiber. A two folded yean comprising 30 denier—12 filaments of polyethylene terephthalate (a twist-set product whose first twist (S direction) was 900 T/m and second twist (Z direction) was 900 T/m) was used as a warp of the ground, and a false-twist-modified textured yarn of 150 denier—48 filaments treated with an added twist of 400 T/m (S direction) and set with a twist-set was used as a weft of the ground. A fabric whose pile length was 10 mm was obtained by means of a double velludo weaving machine. As the fabric density, piled yarn, ground warp and ground weft were 46, 91 and 93 yarns/inch.

Dry heat setting of the fabric thus obtained was carried out and the sea component of the piled composite yarn was removed by treating with trichloroethylene to obtain a piled fabric wherein a number of ultrafine fibers, whose monofilament denier was 0.2 denier, were piled. After drying trichloroethylene, the back surface of the said fabric was coated with a solution comprising 100 parts of polyurethane, 25 parts of DMF and 0.25 parts of a pigment by means of a knife coater machine. The backing treatment of the back surface of the fabric was thereby carried out.

The coating quantity of polyurethane on the fabric was 14,8 g/m$^2$. It was thereafter put into a liquid-flowing circular dyeing machine to make the piles in a reverse direction, and the dyeing treatment was carried out by the following conditions.

| | | |
|---|---|---|
| (1) | Scouring (the treating time: 80° C. × 30 min) | |
| | The treating agents: | |
| | "Sandet G-29" (manufactured by Sanyo Chemical Industries Co., Ltd.) | 0.5 g/lit. |

-continued

| | | |
|---|---|---|
| | Soda ash | 0.5 g/lit. |
| (2) | Dyeing (the treating time: 120° C. × 60 min) | |
| | Dyes: | |
| | Kayalon Polyester Light Red BS | 0.5% owf |
| | Resoline Blue BBLS | 3.0% owf |
| | Samalon Black BBL Liq 150 | 20.0% owf |
| | LAP-50 | 0.5 g/lit. |
| | PH-500 | 0.5 g/lit. |
| (3) | Reduction cleaning (the treating time: 80° C. × 20 min) | |
| | The treating agents: | |
| | NaOH (30%) | 3 g/lit. |
| | Hydrosulphite | 3 g/lit. |
| | Sandet G-29 | 3 g/lit. |

After dyeing, dehydration was done by means of a centrifugal dehydrator.

Then, calendar treatments under the following conditions (A) and (B) were carried out by means of a hydraulic three-roll plastocalendar machine.

TABLE 1

| | (A) | (B) |
|---|---|---|
| Temperature (°C.) | 180 | 200 |
| Pressure (kg/cm$^2$) | 15 | 80 |
| Treating speed (m/min) | 8 | 8 |
| Pile opening state of the treated fabric | Sufficient | A little unsufficient |
| Direction of the fabric put in the calender | Following | Reverse |

During the treatment, the piled part of the fabric was made to contact the heated cylinder roll of the calendar roll. Regarding the fabric treated under the condition (A), its pile opening and handling conditions were made good by brushing before the calendar treatment.

Treated fabrics thus obtained had a layer of apexes of piles being adhered over a wide area and being made in a body with a film-shape.

Crumpling treatment on this treated fabric was carried out by passing this treated fabric through an apparatus for guiding fabric wherein plural bars were placed alternately on a higher and a lower position to make the zigzag curved running of the fabric possible.

The fabrics thus obtained by both treating level (A) and (B) had apexes of piles in a body with a flat-shape and scaly structures.

The area of a constituent unit of said scaly structure of the level (A) was $20\times10^{-2}$ cm$^2$ on the average and had a relatively uniform shape having a relatively small area in the range of $3\times10^{-2}$ cm$^2$ to $36\times10^{-2}$ cm$^2$. The area of the level (B) was $1.5\times10$ cm$^2$ on the average and had various shapes and areas, including small as well as large ones in the range of $25\times10^{-2}$ to $0.8\times10^2$ cm$^2$. All outer appearances were unique and rich in a natural feeling like a bagworm, coal or a skin of a pine tree and rich in luster characteristic, flexibility and cubic effect. The fabric was rich in esthetic and high class feelings which had never been seen before.

In comparing the level (A) with the level (B), it was found that the level (A) gave a mild feeling because each scaly structure was small, while the level (B) gave a bold feeling and a feeling being full of rural beauty because each scaly structure was large.

EXAMPLE 2

As a piled yarn, a filament yarn of 75 denier-18 filaments obtained by spinning and drawing islands-in-a-sea type composite fibers having the following constitution was used.

Island component: Polyethylene terephthalate
Sea component: Polystyrene
Number of the island component: 6
Ratio of the island/the sea component: 80/20
Monofilament denier of the island component: 0.56 denier A false-twisted textured yarn of polyethylene terephthalate of 75D-36f as a warp of the ground and a false-twisted textured yarn of the same polymer of 150D-48f as a weft of the ground were used to obtain a fabric having piles whose length was 11 mm by means of a double velludo weaving machine. Regarding the fabric density, the piled yarn, ground warp and ground weft were 47, 93 and 94 yarns/inch, respectively.

After dry heat setting of the said piled fabric, the sea component of the composite yarns used for piled yarns was removed by treating with trichloroethylene to obtain a piled fabric wherein a number of ultrafine fibers whose monofilament denier was 0.56 denier. After drying the trichloroethylene, the back surface of the said fabric was coated with a solution comprising 100 parts of polyurethane, 13/18 parts of MEK/toluene, 50/5 parts of water/MEK, 2 parts of a crosslinking agent and 0.25 parts of a pigment by means of a knife coater machine the backing treatment of the back surface of the piled fabric was carried out. The coating quantity of polyurethane on the fabric was 22 g/m$^2$. It was thereafter put into a liquid-flowing circular dyeing machine to make the piles in a reverse direction during the dyeing treatment and the dyeing treatment was carried out under the following conditions.

| | | |
|---|---|---|
| (1) | Scouring (the treating time: 80° C. × 30 min) | |
| | The treating agents: | |
| | "Sandet G-29"(manufactured by Sanyo Chemical Industries Co., Ltd.) | 0.5 g/lit. |
| | Soda ash | 0.5 g/lit. |
| (2) | Dyeing (the treating time: 120° C. × 60 min) | |
| | Dyes: | |
| | Resoline Blue BBLS | 2.5% owf |
| | Kayalon Polyester Light Red BS | 3.0% owf |
| | Foron Yellow Brown S-2RFL | 4.6% owf |
| | Palanil Yellow 3G | 1.7% owf |
| | LAP-50 (manufactured by Sanyo Chemical Industries, Co., Ltd.) | 0.5 g/lit. |
| | PH-500 (manufactured by Sanyo Chemical Industries, Co., Ltd.) | 0.5 g/lit. |
| (3) | Reduction cleaning (the treating time: 80° C. × 20 min) | |
| | The treating agents: | |
| | NaOH (30%) | 3 g/lit. |
| | Hydrosulphite | 3 g/lit. |
| | "Sandet G-29" (manufactured by Sanyo Chemical Industries Co., Ltd.) | 3 g/lit. |

After dyeing, dehydration was done by means of a centrifugal dehydrater.

Then, a calendar treatment was carried out by means of a hydraulic three-roll plastocalendar machine. The treating conditions were as follows.

Temperature: 200° C. (The piled part was contacted with the heated cylinder roll)
Pressure: 30 kg/cm$^2$
Treating speed: 8 m/min
Pile opening state of the treated fabric: A little unsufficient
Direction of the fabric put in the calendar: Reverse After the treatment, some crumpling by hand was done, and a resin treatment was then carried out under the following conditions to obtain a dimensional durability.

| | |
|---|---|
| Resin treatment: Resin impregnation (Pick up 57%) → Drying (100° C. × 5 min) → Curing (180° C. × 1 min) | |
| Resin composition: "Sumitex Resin M-3 (manufactured by Sumitomo Chemical Industries, Co., Ltd.) | 20 g/lit. |
| CB-01 (Cosmo Chemical Co., Ltd.) | 2 g/lit. |
| Ammonium Persulphate | 2 g/lit. |
| Resin built-up: | 0.9% |

Moreover, said fabric was put in a Wince dyeing machine containing warm water at 80° C., rotated and moved in the warm water for 20 minutes to crumpling it and dried.

Treated fabrics thus obtained had apexes of piles in a body and good scaly structures. The average area of a constituent unit of said scaly structures was $2.4\times10$ cm$^2$, and the fabric had various large, intermediate and small shapes and areas in the range of $9\times10^{-2}$ cm$^2$ to $0.8\times10^2$ cm$^2$, and the outer appearance exhibited excellent scaly structures. An excellent fabric having an outer apperance like mica and being rich in a natural feeling, a new, raw material feeling and a fushionable characteristic was obtained.

Moreover, durability of said scaly structure was evaluated. The methods for testing durability and the results were as follows.

Moreover, comparison tests on an untreated product without any shape fixing treatment by means of resin treatment were carried out.

TABLE 2

| | Fixed product | Untreated product |
|---|---|---|
| Test 1 | ⊙to o | Δ |
| Test 2 | o to⊙ | x to Δ |
| Test 3 | | Δ to o |

Evaluation level
⊙: No change in shape after the test
o: Little change in shape after the test
Δ: A little change in shape after the test
x: Remarkable change in shape after the test

TESTING METHOD

Test 1: Wearing durability test of an outer coat on both the circumference parts of the elbows and the parts of axillae of which a fabric to be tested was attached was done for one week.

Test 2: Durability test against dry cleanings by means of an ordinary method using perchlene were done for two times in a dry cleaning shop.

Test 3: Abrasion durability test wherein an abrasive go and back cycle test of 50 times was carried out on a surface to be abraded under a pressing load of 500 g by means of Gakushin type abrasion tester.

It is clear from Table 2 that the products whose scaly structure was formed by making in a body with a resin, had better durability.

Moreover, the products adhered with the resin exhibited excellent luster characteristic. The products without resin adherence showed softer feeling and touch but it is recognized that the products with resin adherence also had sufficiently good flexibility.

EXAMPLE 3

The following two kinds of islands-in-a-sea type composite fibers were spun and drawn to obtain blended composite fibers of 65 denier—18 filaments.

| | | |
|---|---|---|
| (a) | The islands-in-a-sea type composite fiber No. 1 | |
| | Island component: | Polyethylene terephthalate (16 islands) |
| | Sea component: | Copolymer of polyethylene terephthalate/isophthalic acid/5-sodium sulfoisophthalic acid/87.5 (70/30)/12.5 mole % |
| (b) | The islands-in-a-sea type composite fiber No. 2 | |
| | Island component: | Polyethylene terephthalate copolymerized with 4.9 mole % of isophthalic acid (16 islands) |
| | Sea component: | Copolymer of polyethylene terephthalate/isophthalic acid/5-sodium sulfoisophthalic acid/87.5 (70/30)/12.5 mole % |

Here, the islands-in-a-sea type composite fiber No. 1 comprised 90% of the island component and 10% of the sea component and the whole fiber was 32.5 denier—9 filaments. The islands-in-a-sea type composite fiber No. 2 comprised 90% of the island component and 10% of the sea component and the whole fiber was 32.5 denier—9 filaments. Therefore, a blended fiber of total 65 denier—18 filaments was obtained.

This blended composite fiber was used as a pilable fiber. A false-twisted textured yarn comprising 75 denier—36 filaments of polyethylene terephthalate was used as a warp of the ground, and a false-twisted textured yarn of 100 denier—48 filaments of polyethylene terephthalate was used as a weft of the ground. A fabric whose pile length was 6 mm was obtained by means of a double velludo weaving machine. Regarding fabric density, the piled yarn, ground warp and ground weft were 45.5, 91 and 107 yarns/inch.

After dry heat setting of the fabric of the fabric thus obtained was carried out, the following treatment, was carried out by means of a liquid-flowing circular dyeing machine.

| | | |
|---|---|---|
| (1) | Treatment for preparing a ultra-fine fiber | |
| | The 1st treatment: | |
| | Treating agent: Malechead CM (manufactured by Takeda Chemicals Industry Co., Ltd.) | 1 g/lit. |
| | Treating temperature × time: | 120° C. × 30 minutes |
| | The 2nd treatment: | |
| | Treating agent: NaOH (30%) | 3 g/lit. |
| | Treating temperature × time: | 80° C. × 30 minutes |
| (2) | Dyeing (the treating time: 120° C. × 60 min) | |
| | Dyes: | |
| | Resoline Blue BBLS | 0.53% owf |
| | Kayalon Polyester Light Red BS | 0.73% owf |
| | Foron Yellow Brown S-2RFL | 3.2% owf |
| (3) | Reduction cleaning | |
| | The treating agents: | |
| | NaOH (30%) | 3 g/lit. |
| | Hydrosulphite | 3 g/lit. |
| | Sandet G-29 | 1 g/lit. |
| (4) | Silicone treatment | |
| | Treating agent: | |
| | Ultratex ESC (manufactured by CIBA-GEIGY) | 0.3% owf |
| | Treating temperature × time: | 20° C. × 10 minutes |

A ultra-fine piled fabric whose monofilament denier was 0.2 denier was obtained by these treatments. After drying said ultra-fine piled fabric, a calendar treatment using the below described conditions was carried out by means of a hydraulic three-roll plastocalendar machine.

The treating conditions were as follows.

Temperature: 190° C. (The piled part was contacted with the heated cylinder roll)

Pressure: 30 kg/cm$^2$

Treating speed: 8 m/min

Pile opening state of the treated fabric: A little unsufficient

Direction of the fabric put in the calendar: Reverse

A resin treatment under the following conditions was immediately carried out on the calendar treated fabric thus obtained.

| | |
|---|---|
| Resin treatment process: Resin impregnation (Pick up 41%) → Drying (100° C. × 5 min) → Curing (120°C. × 3 min) | |
| Resin composition: "Sumitex Resin M-3" (manufactured by Sumitomo Chemical Industries, Co., Ltd) | 28 g/lit. |
| CB-01 (Cosmo Chemical Co., Ltd.) | 2 g/lit. |
| Ammonium Persulphate | 2 g/lit. |
| Resin built-up: | 0.3% |

Moreover, said fabric was put in a liquid-flowing circular dyeing machine and said fabric was circulated in said liquid-flowing circular dyeing machine for 12 minutes to carry out a crumpling treatment. The bath ratio was 1:30, and the nozzle pressure was 1.2 kg/cm$^2$.

The three dimensional fabric of the present invention thus obtained had a scaly structure whose constituent unit was in the range of $1\times10^{-2}$ cm$^2$ to $5\times10^{-2}$ cm$^2$ and relatively small and whose size was relatively uniform.

This three dimensional fabric had a number of small scaly structures densely covering its surface, and the outer appearance was beautiful with these scaly structures. The fabric exhibited a mild feeling and was rich in a natural feeling, a new, raw material feeling and a fashionable characteristic.

The three dimensional fabric of Example 3 was different from those of Examples 1 and 2 because the piled fabric had no backing treatment with a resin. The touch of the fabric was therefore very soft and the fabric was good for apparel use having excellent drapery.

INDUSTRIAL APPLICABILITY

The three dimensional fabric having a unique structure of the present invention can be widely used in such various applications that fashion characteristics are important by utilizing its new, raw material feeling and unexpected feeling.

Namely, it can be used for fashionable outer wears, for example, over coatings such as an overcoat, a raincoat, a cape, a shawl and so on, jackets such as a jacket, a suit, a business suit, and so on, trousers such as slacks, pants and so on, and outer wears such as hats, gloves and so on.

It can be also used for a surface raw material for bags rich in a fashionable feeling, for example, bags such as a bag, a handbag and so on, various briefcases and various suitcases.

Moreover, it can be also used for wall decorative materials such as inner and outer wall materials being rich in a new feeling and a new, raw material feeling.

Moreover, it can be also used for interior materials such as a curtain, a floor material, carpets, a chair cloth, a case for exhibiting goods, a tent material of a shop and so on.

Moreover, it can be also used for shoes, boots and so on.

We claim:

1. A three dimensional fabric having a face surface, an opposite fabric surface and a piled body of pile fibers therebetween, said pile fibers, at the apex end at said face surface of said structure being abutted and joined to form contiguous, substantially flat, scaly-like areas each bounded by a boundary, and said scaly-like areas cover said face surface of the fabric.

2. A three dimensional fabric as described in claim 1 characterized by said scaly-like areas having substantially no definite pattern.

3. A three dimensional as described in claim 1 characterized by the fact that the average area of a constituent unit of the scaly structure is $0.5\times10^{-2}$ $cm^2$ to $1\times10^2$ $cm^2$.

4. A three dimensional fabric as described in claim 1 characterized by a structure wherein at least in a part of the circumferential part of the apexes of the scaly structure, a monolithic structure, wherein a number of apexes of piled fibers are made in a body with a flat-shape in a mass, is split and a fibrous state appears.

5. A three dimensional fabric as described in claim 1, 2, 3 or 4 characterized by a structure wherein a number of apexes of piled fibers are made in a body with a resin with a flat-shape in a mass to form the scaly structures.

* * * * *